US008808057B2

(12) United States Patent
Hu

(10) Patent No.: US 8,808,057 B2
(45) **Date of Patent: *Aug. 19, 2014**

(54) BREAST ENHANCING BRASSIERE

(75) Inventor: Xiao Qing Hu, New York, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 272 days.

This patent is subject to a terminal disclaimer.

(21) Appl. No.: 13/349,717

(22) Filed: Jan. 13, 2012

(65) Prior Publication Data

US 2012/0184180 A1 Jul. 19, 2012

Related U.S. Application Data

(63) Continuation-in-part of application No. 12/782,156, filed on May 18, 2010, now Pat. No. 8,506,348.

(51) Int. Cl.

| | |
|---|---|
| ***A41C 3/00*** | (2006.01) |
| ***A41C 3/10*** | (2006.01) |
| ***A41C 3/14*** | (2006.01) |

(52) U.S. Cl.

CPC . *A41C 3/10* (2013.01); *A41C 3/144* (2013.01); *A41B 2400/38* (2013.01)

USPC ..... 450/54; 450/56; 450/55; 450/57; 2/267; 2/268

(58) Field of Classification Search

USPC ..... 450/36–38, 54–57; 2/267, 268

See application file for complete search history.

(56) References Cited

U.S. PATENT DOCUMENTS

| | | | |
|---|---|---|---|
| 2,420,472 | A | 5/1947 | Freedman |
| 3,568,681 | A | 3/1971 | Comollo |
| 5,098,330 | A | 3/1992 | Greenberg |
| 5,334,082 | A | 8/1994 | Barker |
| 6,231,423 | B1 | 5/2001 | Deal et al. |
| 6,431,945 | B1 | 8/2002 | Stephens et al. |
| 6,544,100 | B1 | 4/2003 | Nadsady et al. |
| 6,811,464 | B2 | 11/2004 | Li |
| 6,824,444 | B2 | 11/2004 | Huang |

(Continued)

FOREIGN PATENT DOCUMENTS

FR 2911478 A1 7/2008

OTHER PUBLICATIONS

International Search Report and Written Opinion of the International Searching Authority for PCT/US2011/032116, European Patent Office, Jose Mendo perez, Jul. 19, 2011.

*Primary Examiner* — Gloria Hale

(74) *Attorney, Agent, or Firm* — Womble Carlyle Sandridge & Rice LLP

(57) ABSTRACT

A breast-enhancing brassiere is provided having a pair of breast-receiving cups, each cup including at least one cushioned layer having an inner breast-receiving side and an outer side, and having at least one outer fabric layer affixed to the outer side of the cushioned layer, the inner breast-receiving side including a lower portion and an upper portion, the lower portion having a cushioned thickness greater than the cushioned thickness of the upper portion and projecting inwardly to provide lift and breast enhancement to a wearer, a first pocket formed on the inner breast-receiving side and having a slit formed therein, and a first cushion conforming substantially to the shape of the pocket, the cushion being removably insertable into the pocket to provide supplemental lift and breast enhancement to a wearer.

33 Claims, 8 Drawing Sheets

(56) References Cited

U.S. PATENT DOCUMENTS

| | | | | |
|---|---|---|---|---|
| 7,074,108 | B2 | 7/2006 | Knox | |
| 7,666,059 | B2 | 2/2010 | Falla et al. | |
| 8,506,348 | B2 * | 8/2013 | Hu | 450/54 |
| 2009/0061731 | A1 | 3/2009 | Redenius | |
| 2011/0287691 | A1 * | 11/2011 | Hu | 450/56 |

* cited by examiner

BREAST ENHANCING BRASSIERE

CROSS-REFERENCE TO RELATED APPLICATIONS

This application is a continuation-in-part of U.S. patent application Ser. No. 12/782,156, filed on May 18, 2010, now U.S. Pat. No. 8,506,348, the entirety of which is incorporated by reference herein.

FIELD OF THE INVENTION

The present invention relates to the field of women's undergarments, and, in particular, to a brassiere having breast-receiving cups with supplemental padding and removable cushion inserts to enhance the shape of the breasts when the brassiere is worn.

BACKGROUND OF THE INVENTION

Brassieres designed for shaping, lifting, and enhancing the appearance of a woman's breasts are well known in the intimate apparel arts. Brassieres having padding or other cushioning materials sandwiched between layers of fabric material at the lower portions of the breast-receiving cups are sometimes worn by women who desire to enhance their appearance and/or accent their cleavage without resorting to surgical procedures.

Numerous attempts have been made to advance the art of breast enhancement; most, however, have been minimally effective, i.e., they have resulted in an artificial look and additionally may be uncomfortable when the brassiere is worn. The enhancement brassieres currently known in the art incorporate similarly-dimensioned padding, cushions, gel packs, etc. into both of the brassiere breast-receiving cups, typically on the lower portion of each breast-receiving cup. Thus, while a brassiere so constructed may fit perfectly for some women, a "one-size-fits-all" approach frustrates many wearers by providing either too little or too much lift and enhancement.

Additionally, for women having unevenly sized breasts, which account for a significant portion of the population, wearing a brassiere where both breast-receiving cups are identically dimensioned provides unacceptable results.

While numerous, and some costly, solutions to address these problems have been devised, none addresses the problems of providing the desired degree of enhancement and accommodating unevenly sized breasts, while at the same time providing an aesthetically pleasing appearance when the brassiere is worn and that can be manufactured at a relatively low cost.

SUMMARY OF THE INVENTION

The present invention is directed to a breast-enhancing brassiere which permits a wearer to select multiple levels of breast support, lift and profile enhancement, depending upon the wearer's individual breast size(s) and desired appearance. The breast-enhancing brassiere comprises a pair of breast-receiving cups, with each cup including multiple cushioned layers having an inner breast contacting side and an outer side, at least one outer fabric layer affixed to the outer side of the cushioned layer, and an inner breast-contacting side having a lower periphery and an upper periphery. The lower periphery of each cup includes additional cushioned thickness to provide a first level of support, lift and profile enhancement. The overall thickness of the cushioned layers may be varied by cup size; e.g., a B cup will have a thicker combination of cushioned layers than a D cup. A first pocket also is formed on the breast-receiving side and has a slit formed therein. A first cushion conforming substantially to the shape of the pocket is removably insertable into the pocket, such that the first cushion provides a second, optional level of support, life and profile enhancement to the wearer of the brassiere.

In one embodiment, the first cushion has a geometric center with a thickness that is greater than the thickness at the outer edges of the cushion. Another exemplary embodiment comprises a second cushion that is smaller than, and substantially conforms to the shape of, the first cushion and is removably insertable into a pocket within the first cushion to provide yet a third optional level of support, lift, and profile enhancement to the wearer.

Various features and aspects of the invention will become apparent upon review of the detailed description set forth below when taken in conjunction with the accompanying drawings, which are briefly described as follows.

DETAILED DESCRIPTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications, and improvements are within the scope of the present invention.

Figure 1:
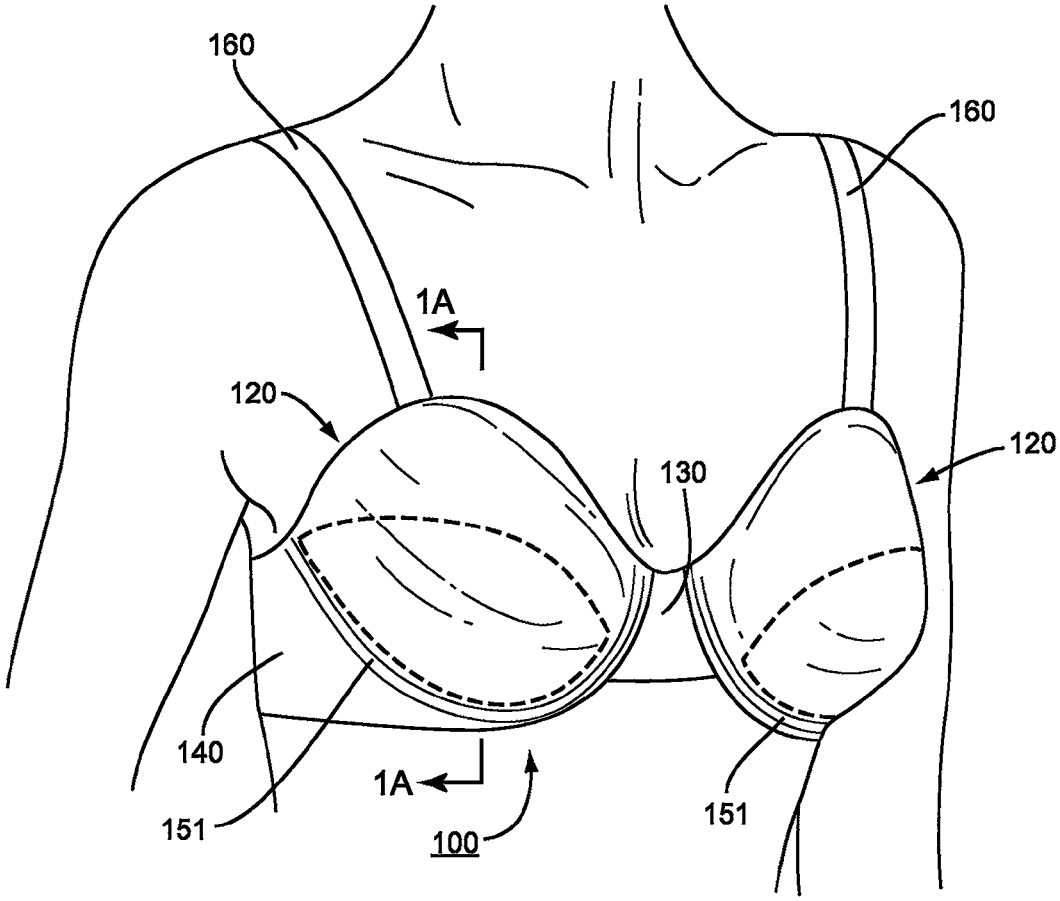
FIG. 1 is a front perspective, environmental view of a breast-enhancing brassiere formed according to the present invention.

Referring to FIG. 1, the present invention is directed to a breast enhancing brassiere, shown generally as 100. The breast enhancing brassiere 100 comprises a pair of breast-receiving cups 120, and a pair of torso-encircling bands 140, each torso encircling band 140 extending outwardly from a breast-receiving cup 120. The brassiere 100 also includes a pair of shoulder straps 160, with each shoulder strap 160 extending between one of the breast receiving cups 120 and one of the torso-encircling bands 140. Alternatively, the breast enhancing brassiere may be strapless. In one exemplary embodiment, the brassiere 100 may further comprise a centrally-located gusset 130 interconnecting the pair of breast-receiving cups 120.

Figure 2:
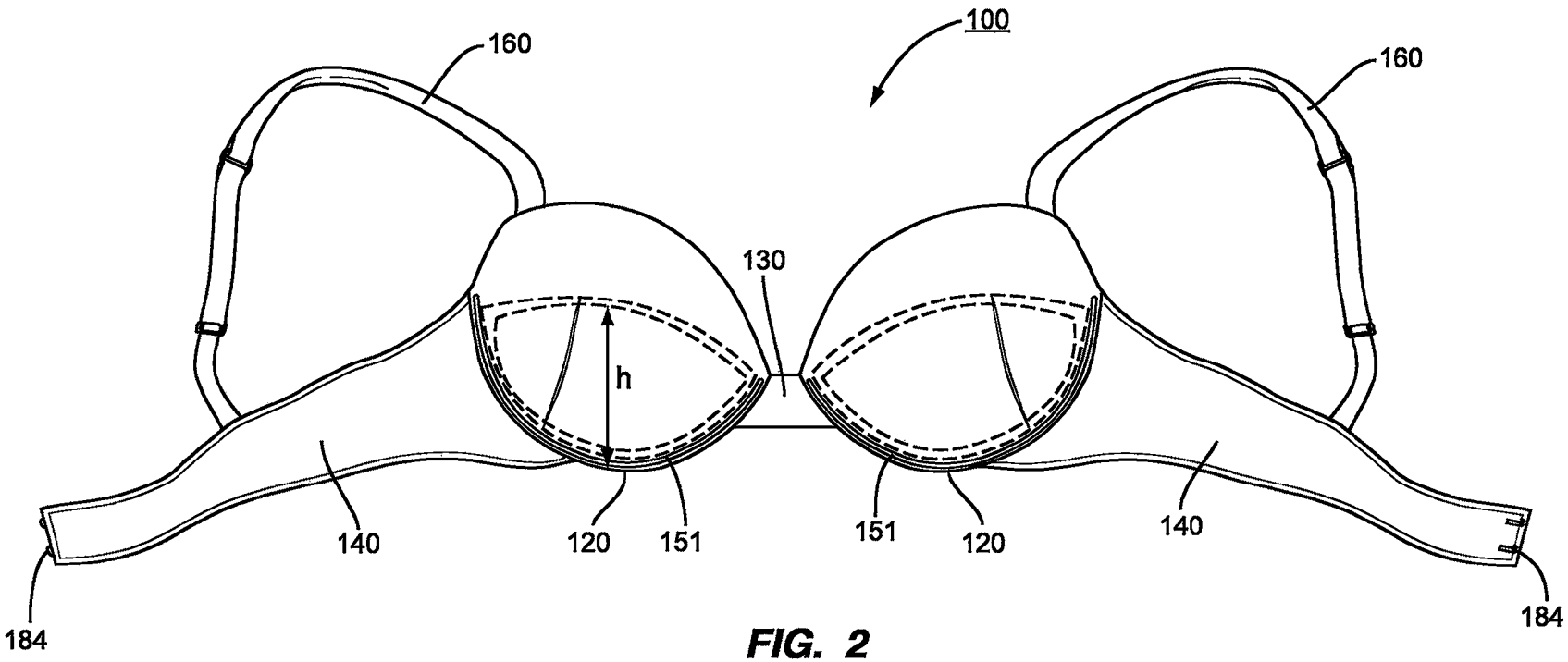
FIG. 2 is a rear perspective view of the brassiere of FIG. 1, illustrating the shape and placement of the pocket for insertion of a cushion therein.

As best shown in FIG. 2, the torso-encircling bands 140 will encircle the wearer's torso and interconnect at the back of the wearer with any conventional closure means 184, such as a hook and eye closure, hook and loop closure, etc. Alternatively, the brassiere 100 may comprise a front closure (not shown) in lieu of a central gusset 130, or may comprise a continuous band without any back or front closure means in the case of a pullover, or sports-type brassiere construction. The torso-encircling band portions 140 and the shoulder straps 160 may be formed of conventional single or multi-layer fabrics, such as, cotton, polyester, nylon, rayon, elastomerics, etc., natural and synthetic, and combinations thereof.

Figure 3:
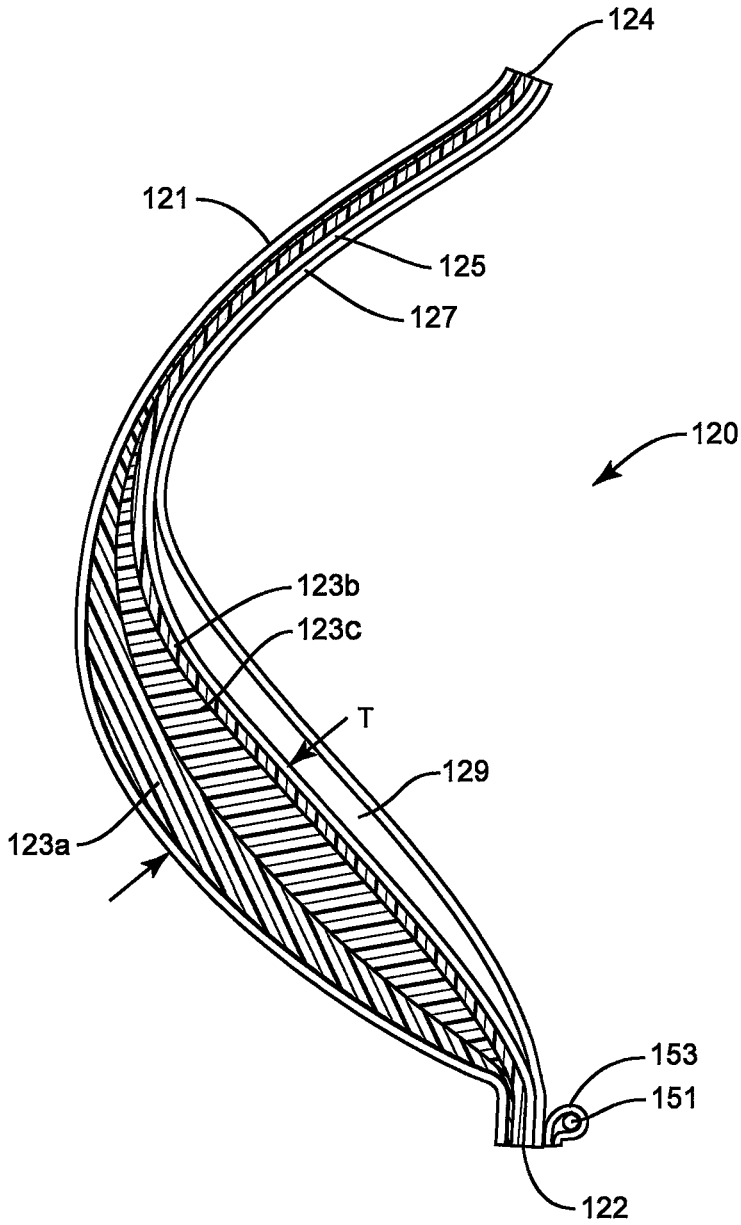
FIG. 3 is a sectional view of the brassiere of FIG. 1, taken along Line 1A-1A.

Referring to FIG. 3, a cross-sectional view of a multi-layered breast-receiving cup 120 is shown in detail. In the embodiment shown, each breast-receiving cup 120 comprises at least one fabric outer layer 121, which is affixed to a first cushioned layer 123*a* of lofted material. As used herein, the term "lofted material" includes foam (polyurethane or high density), latex rubber, circularly knitted and/or warp knitted single ply materials, batting, spacer fabric, fiberfill, and combinations thereof. In one exemplary embodiment, the fabric outer layer 121 may be laminated to the first cushioned layer 123*a* of lofted material by a conventional molding process. To provide a first level of breast enhancement, as shown in FIG. 3, the first cushioned layer 123*a* has a tapered cross-section, gradually increasing in thickness from the upper periphery 124 downwardly through the lower portion of the breast-receiving cup 120, thus projecting inwardly, before decreasing in thickness toward the lower periphery 122. In the embodiment shown, a second tapered and cushioned layer 123*c* is adhered or molded adjacent the first cushioned layer 123*a* to provide additional support and lift in the lower half of the cup 120. The taper of this second intermediate cushioned layer 123*c* may be varied during construction of the brassiere 100 to obtain a degree of lift desired for a particular cup 120 size. In addition to being formed of a lofted material, in some embodiments the second intermediate cushioned layer 123*c* may comprise a packet of gel, air, oil, pellets, etc. Alternatively, the second intermediate cushioned layer may be eliminated altogether, e.g., for larger cup sizes such as D and DD not requiring additional lift. Lastly, a third and inner cushioned layer 123*b*, having a uniform thickness is adhered or molded adjacent the second cushioned layer 123*c* to provide additional cushioning and a substantially smooth inner cushioned surface across substantially the entire inner surface of the cup 120. For some wearers, the first level of support and lift provided by this multi-layered structure of molded cushioning will provide sufficient and satisfactory breast profile enhancement. Further, the material densities of the first outer cushioned layer 123*a* and the third inner cushioned layer 123*b* may be varied, e.g., more dense where more support is required, and less dense where more comfort is desired.

Another aspect of this exemplary embodiment of the breast-receiving cup 120 is that the maximum thickness may be varied depending upon the cup 120 size, as shown in FIG. 3, the maximum thickness is dimension 'T' of the lower portion of the cup 120, including cushioned layers 123*a*, 123*b*, 123*c*, and fabric layers 121, 125. For example, an A-size cup will have a greater maximum thickness than a D-size cup. It has been found that the difference in maximum thickness between each cup size may vary by about 3/16 of an inch, or about 0.188 inches. Thus, in this embodiment, an A-size cup has a dimension 'T' of about 0.95 inches, a B-size cup a dimension 'T' of about 0.75 inches, a C-size cup a dimension 'T' of about 0.55 inches, and a D-cup a dimension 'T' of about 0.35 inches.

In this exemplary embodiment, the breast-receiving cup 120 also comprises an inner fabric layer 125 that is laminated during the molding process to the innermost layer 123*b* of lofted material. The fabric layers may be formed from any of the commonly known yarns and fibers including, but not limited to, cotton, polyester, nylon, rayon, elastomerics, etc., natural and synthetic, and combinations thereof. Methods of laminating and molding multiple layers of varying types of materials are well known in the art.

As best shown in FIGS. 2 and 3, a first cushion pocket 129 is formed over the inner breast contacting surface of the breast-receiving cup 120, closest to a wearer's skin, which provides additional support, lift and profile enhancement. The first cushion pocket 129 may be substantially oval shaped and comprises a first fabric layer 127. The fabric layer 127 is affixed about the lower periphery 122 of the breast-receiving cup 120 and extends upwardly to a height 'h' that is spaced apart from the upper periphery 124 of breast-receiving cup 120. Extending upwardly from height 'h', the fabric layer 127 is affixed or laminated to the second fabric layer 125. Alternatively, the fabric layer 127 may be shaped so that it ends at height 'h' and is stitched or bonded to the inner fabric layer 125. Below height 'h', the fabric layer 127 is unattached except at the lower periphery 122. The fabric layers 125 and 127 combined then form a substantially oval shaped pocket 129. As used herein, the phrase "substantially oval," refers to any oval shape including, but not limited to, an oval, an ellipse, a football shape, or a vesica piscis, where the upper and lower curved edges meet at either rounded or pointed, opposed ends.

Figure 4:
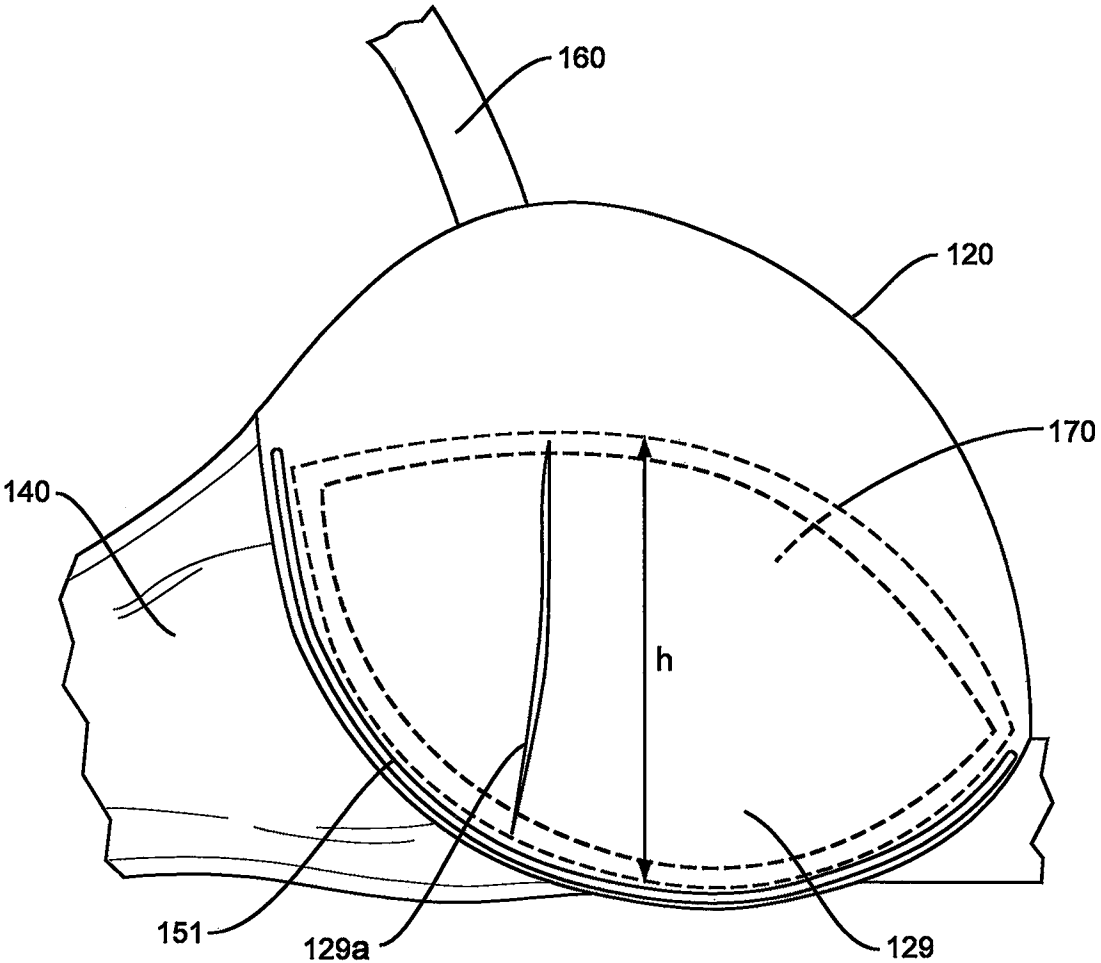
FIG. 4 is a close-up view of the left brassiere cup of FIG. 2, illustrating the placement of the slit formed in the pocket for insertion of a cushion.

As best shown in FIG. 4, a slit 129*a* is formed in the fabric layer 127 so that a cushion insert, described in greater detail below, may be inserted into the pocket 129 to provide a second level of additional support, lift and profile enhancement. In one embodiment, the slit 129*a* is substantially vertical. When there is no cushion insert in the pocket 129, the fabric layer 127 may lay substantially parallel to the inner surface of the breast-receiving cup 120. Thus, the fabric layer 127 may have some elastic properties so that it will be somewhat taut and will not sag or bunch up within the breast-receiving cup 120 when worn. This means that the brassiere 100 is completely functional for wear and support of the breasts when the wearer desires no additional breast profile enhancement.

Figure 5A:
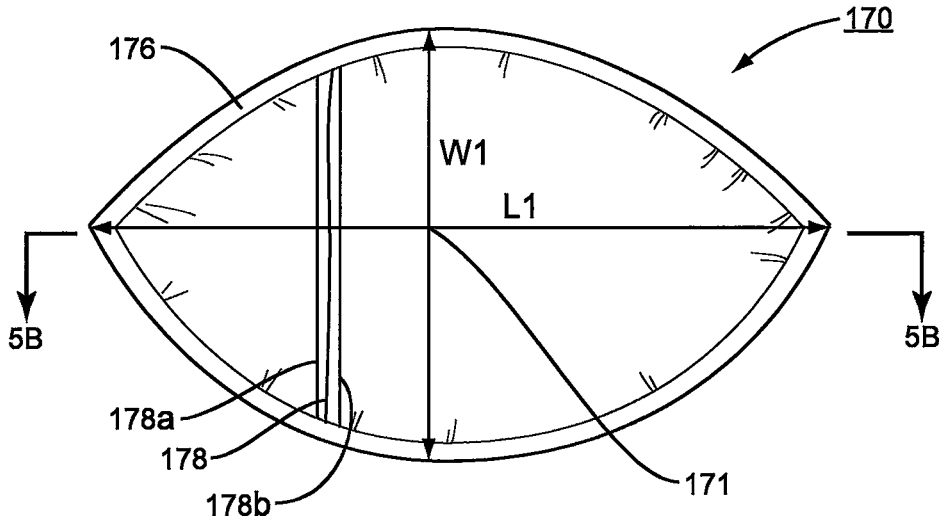
FIG. 5A is an elevational view of a first cushion insert.
Figure 5B:
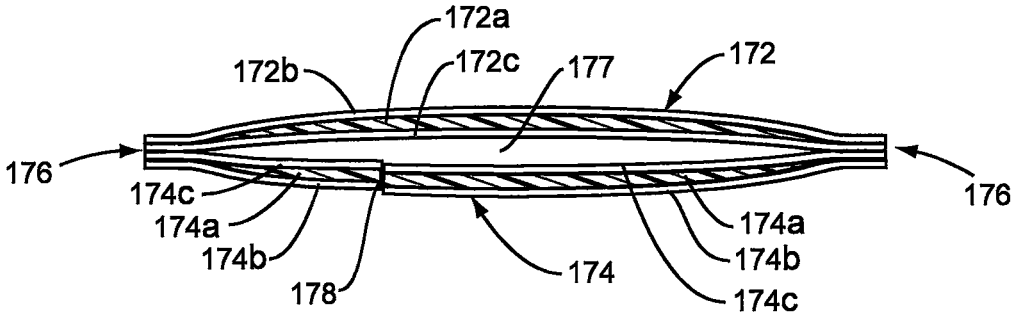
FIG. 5B is the elevational view of a second cushion insert.

Turning now to FIGS. 5A through 6B, the breast-enhancing cushions 170, 180 are illustrated. As shown in FIGS. 5A and 5B, a first cushion 170 is formed in the general shape and dimension of the pocket 129, the cushion 170 being slightly smaller than the pocket 129 so that it will fit into the pocket 129. The cushion 170 may be substantially oval shaped. As shown in FIG. 5B, the first cushion 170 comprises a first cushion portion 172 having a lofted layer 172*a* sandwiched between fabric layers 172*b* and 172*c*, and a second cushion portion 174 that is sandwiched between fabric layers 174*b* and 174*c*. The lofted and fabric layers used to form the cushion portions 172 and 174 may be the same as those used to construct the layers of the breast-receiving cup 120. The cushion portions 172, 174 may be attached to each other by stitching or bonding along an entire peripheral edge 176, forming another inner pocket, having a volume 177. The first cushion 170 further comprises a geometric center 171, a length 'L1' along its long axis, and a width 'W1' along its short axis. The geometric center 171 of the first cushion 170 may have a thickness that is greater than the thickness at the outer peripheral edge 176, i.e., the thickness decreases from the geometric center 171 outwardly to the peripheral edge 176. In one embodiment, the geometric center has a thickness of between about 0.30 inches and 0.35 inches, tapering outwardly to a thickness at the peripheral edge 176 of between about 0.15 inches and 0.17 inches. When constructed with a tapered thickness, a more natural look and shape is created for each breast.

Figure 6A:
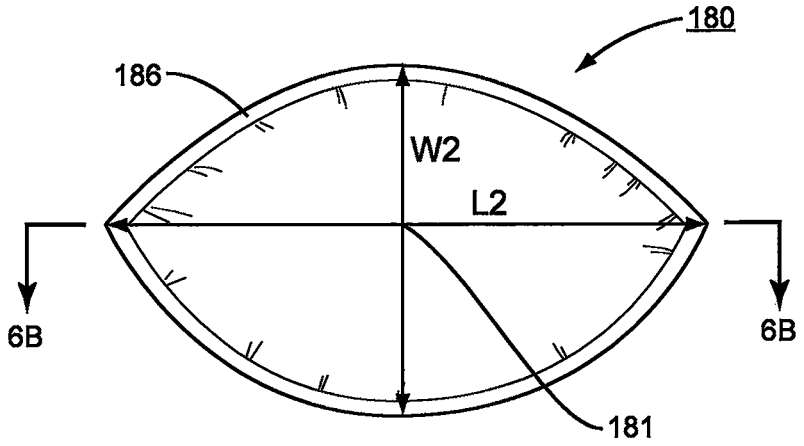
FIG. 6A is a cross-sectional view of the first cushion insert along its long axis.
Figure 6B:
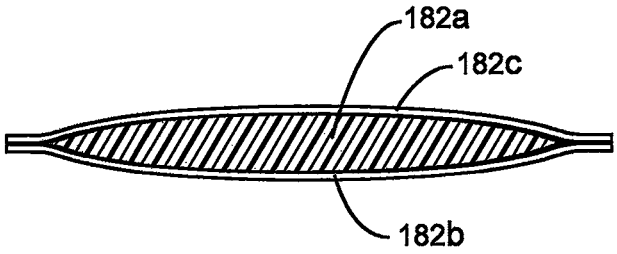
FIG. 6B is a cross-sectional view of the second cushion insert along its short axis.

As discussed in greater detail below, if additional breast enhancement is desired, or alternatively, where the wearer has unevenly sized breasts and requires additional cushioning and/or lift for one or both breasts, the first cushion 170 may comprise a slit 178 formed through and along the short, or width 'W1' axis, of one of the first or second cushion portions 172, 174. The slit 178 may be a substantially vertical slit. Hems 178*a*, 178*b* may be formed along the vertical slit 178 to facilitate inserting a second cushion 180 into the inner volume 177.

Where yet a third level of additional support, lift and profile enhancement is desired, a second cushion 180 is provided having a similar oval shaped geometry and is dimensioned for insertion through slit 178 into the inner volume 177 of cushion 170. As shown in FIGS. 6A and 6B, cushion 180 comprises a foam layer 182*a* that is sandwiched between fabric layers 182*b* and 182*c*. The second cushion 180 also comprises a geometric center 181, a length 'L2' along its long axis, and a width 'W2' is along its short axis. The geometric center 181 of the second cushion 180 also has a thickness that is greater at the geometric center 181 than the thickness of the cushion 180 at the outer periphery 186. In one embodiment, the geometric center has a thickness of between about 0.17 inches 0.19 inches, tapering outwardly to a thickness at the peripheral edge 176 of between about 0.10 inches and 0.11 inches. The greater thickness at the geometric centers of the cushions 170, 180 again creates a more natural look and shape of each breast when the brassiere 100 is worn.

Figure 7A:
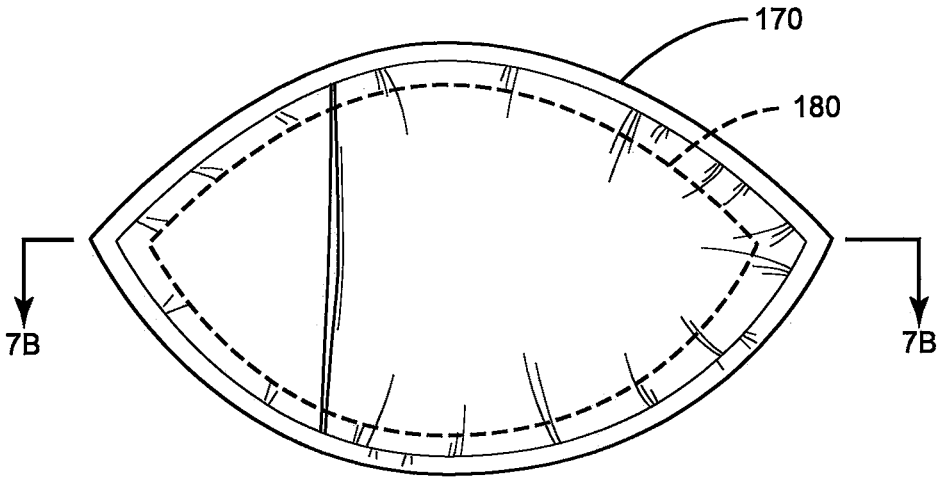
FIG. 7A is an elevational view of a second cushion inserted within a first cushion.
Figure 7B:
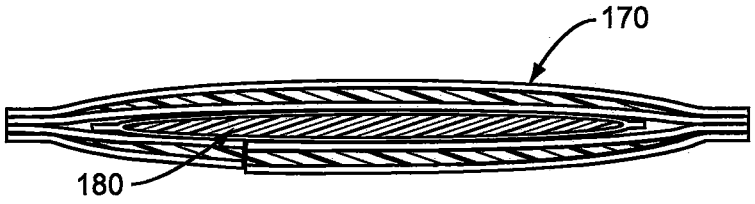
FIG. 7B is a cross-sectional view of a second cushion inserted within a first cushion.

Turning to FIGS. 7A and 7B, a composite cushion is shown, with the second cushion 180 inserted within the first cushion 170. As shown in FIG. 7B, the combination of the first and second cushions 170, 180 increases the thickness of the cushioning, providing additional breast enhancement to the wearer.

Figure 8A:
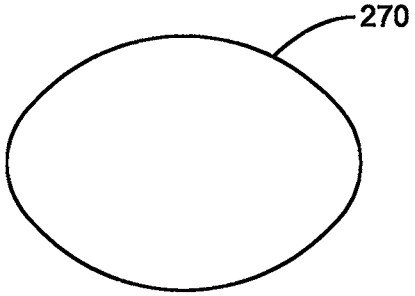
FIG. 8A is an alternative embodiment of a first or second cushion.
Figure 8B:
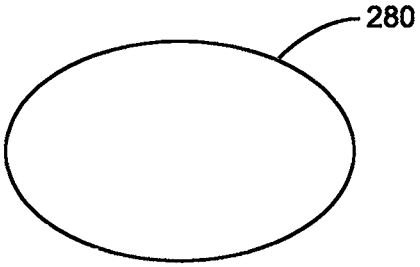
FIG. 8B is another alternative embodiment of a first or second cushion.

Although the Figures illustrate cushions 170, 180 as being substantially oval with pointed edges, i.e., vesica piscis, the present invention is not limited thereto. Rather, as described above, the cushions may have a variety of oval shapes, including, but not limited to exemplary embodiments such as those shown in FIGS. 8A and 8B, FIG. 8A illustrating an exemplary oval 270 having rounded ends, and FIG. 8B illustrating an ellipse 280.

Referring again to FIG. 3, to provide even further undercup support, an underwire element 151 may be encased in a fabric cover 153, which is affixed about the lower periphery 122 of each breast receiving cup 120. The underwire element 151 may be flat or rounded, rigid or semi-rigid, plastic or metal. The fabric cover may be formed from any suitable material that provides suitable cushioning for the underwire element 151 and comfort to the wearer. In the embodiment shown, the fabric cover 153 is stitched to fabric layer 127 forming the pocket 129.

Although the present invention has been described with an exemplary embodiment, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A breast enhancing brassiere, comprising:

(a) a pair of breast-receiving cups, each cup comprising:

at least one cushioned layer having an inner breast-receiving side and an outer side, and having at least one outer fabric layer affixed to the outer side of the at least one cushioned layer;

the inner breast-receiving side including a lower portion having a lower periphery and an upper portion having an upper periphery, the lower portion having a cushioned thickness that is greater than the cushioned thickness of the upper portion and that projects inwardly;

a first pocket formed on the inner breast-receiving side and having a slit formed therein; and (b) a first cushion conforming substantially to the shape of the first pocket, the cushion being removably insertable into the first pocket;

wherein the cushioned layer provides support and breast enhancement to a wearer and the first cushion, when inserted into the first pocket, provides supplemental lift and breast enhancement to a wearer.

2. The brassiere of claim 1, wherein the cushioned thickness of the lower portion has a maximum thickness.

3. The brassiere of claim 2, wherein the maximum thickness varies with the size of the breast receiving cup.

4. The brassiere of claim 3, wherein the maximum thickness is from about 0.35 inches to about 0.95 inches.

5. The brassiere of claim 1, wherein the at least one cushioned layer comprises multiple layers.

6. The brassiere of claim 1, wherein the at least one cushioned layer is formed from lofted material.

7. The brassiere of claim 6, wherein the lofted material is selected from the group consisting of foam, circularly knitted material, warp knitted material, batting spacer fabric, fiberfill, and combinations thereof.

8. The brassiere of claim 1, wherein the at least one fabric layer is molded with the at least one cushioned layer.

9. The brassiere of claim 1, wherein the first pocket is substantially oval-shaped.

10. The brassiere of claim 1, wherein the first pocket is formed of an innermost fabric layer attached to at least a portion of the inner breast-receiving side.

11. The brassiere of claim 1, wherein the first pocket extends upwardly from the lower periphery of each cup to a height spaced from the upper periphery.

12. The brassiere of claim 1, wherein the slit formed in the first pocket is substantially vertical.

13. The brassiere of claim 1, wherein the first cushion is substantially oval-shaped.

14. The brassiere of claim 1, wherein the first cushion comprises:

a first cushion portion having an outer periphery;

a second cushion portion having an outer periphery; and the first and second cushion portions attached about their outer peripheries and defining a second pocket therebetween.

15. The brassiere of claim 14, wherein at least one of the first and second cushion portions comprises:

an outer fabric layer;

an innermost fabric layer; and a lofted material layer therebetween the outer fabric layer and the innermost fabric layer.

16. The brassiere of claim 15, wherein the lofted material layer is selected from the group consisting of foam, circularly knitted single ply material, warp knitted single ply material, batting spacer fabric, fiberfill, and combinations thereof.

17. The brassiere of claim 14, further comprising a slit formed in one of the first cushion portion and the second cushion portion.

18. The brassiere of claim 17, wherein the slit is substantially vertical.

19. The brassiere of claim 14, further comprising a second cushion conforming substantially to the shape of the second pocket, the second cushion being removably insertable into the second pocket, wherein the second cushion provides additional support and breast enhancement to the wearer.

20. The brassiere of claim 13 wherein the first substantially oval shaped cushion comprises a geometric center, a length along a long axis, a width along a short axis, and having a thickness at the geometric center that is greater than the thickness at the outer periphery.

21. The brassiere of claim 20, wherein the thickness at the geometric center is from about 0.3 inches to about 0.35 inches, and the thickness at the outer periphery is from about 0.15 inches to about 0.17 inches.

22. The brassiere of claim 1, further comprising an inner fabric layer affixed to an inner side of the at least one cushioned layer.

23. A breast enhancing brassiere, comprising:

(a) a pair of breast-receiving cups, each cup comprising a cushioned layer having an inner breast-receiving side and an outer side, wherein the cushioned layer includes a lower portion having a lower periphery and an upper portion having an upper periphery, the lower portion having a thickness that is greater than the thickness of the upper portion, an outer fabric layer joined to the outer side of the cushioned layer, and an inner fabric layer partially joined to the inner side of the cushioned layer, so that a pocket is defined between the inner fabric layer and the inner side of the cushioned layer, wherein the inner fabric layer includes a slit for accessing the pocket; and (b) a cushion shaped to be removably received in the pocket.

24. The brassiere of claim 23, wherein the thickness of the lower portion of the cushioned layer is less than about 0.95 inches.

25. The brassiere of claim 23, wherein the pocket and the cushion are substantially oval-shaped.

26. The brassiere of claim 23, wherein the pocket is defined between the lower periphery of each cup to a height spaced from the upper periphery.

27. The brassiere of claim 23, wherein the slit of the inner fabric layer is substantially vertical.

28. The brassiere of claim 23, wherein the cushion is a first cushion, and the first cushion includes a pocket for removably receiving a second cushion.

29. The brassiere of claim 28, wherein at least one of the first cushion and the second cushion comprises a lofted material selected from the group consisting of foam, circularly knitted single ply material, warp knitted single ply material, batting spacer fabric, fiberfill, and any combination thereof.

30. A breast enhancing brassiere, comprising:

(a) a pair of breast-receiving cups, each cup having a breast-receiving side and an exterior side opposite the breast-receiving side, wherein the cup comprises a pocket, and an opening for accessing the pocket, wherein the opening is positioned along the breast-receiving side of the cup;

(b) a first cushion shaped to be removably received in the pocket of the breast-receiving cup, wherein the first cushion comprises a pocket, and an opening for accessing the pocket of the first cushion; and (c) a second cushion shaped to be removably received in the pocket of the first cushion.

31. The brassiere of claim 30, wherein the breast-receiving cup comprises a cushioned layer having a thickness that is greater along a lower portion of the cushioned layer than along an upper portion of the cushioned layer, so that the lower portion of the cushioned layer projects inwardly towards the breast-receiving side of the cup.

32. The brassiere of claim 31, wherein the thickness of the lower portion of the cushioned layer is from about 0.35 inches to about 0.95 inches.

33. The brassiere of claim 31, wherein the cushioned layer has a geometric center and a periphery, and the thickness of the cushioned layer at the geometric center is from about 0.3 inches to about 0.35 inches, and the thickness of the cushioned layer at the outer periphery is from about 0.15 inches to about 0.17 inches.

* * * * *